US011619052B2

(12) United States Patent
Goedert

(10) Patent No.: US 11,619,052 B2
(45) Date of Patent: Apr. 4, 2023

(54) RAILING AND SUPPORT STRUCTURES WITH INTERNAL ILLUMINATION

(71) Applicant: DECK & PORCH LOLAB RAILINGS, LLC, Ferndale, MI (US)

(72) Inventor: Charles G. Goedert, Ferndale, MI (US)

(73) Assignee: DECK & PORCH LOLAB RAILINGS, LLC, Ferndale, MI (US)

( * ) Notice: Subject to any disclaimer, the term of this patent is extended or adjusted under 35 U.S.C. 154(b) by 93 days.

(21) Appl. No.: 17/400,228

(22) Filed: Aug. 12, 2021

(65) Prior Publication Data

US 2023/0047520 A1 Feb. 16, 2023

(51) Int. Cl.

| | |
|---|---|
| ***E04F 11/18*** | (2006.01) |
| ***F21S 4/20*** | (2016.01) |
| ***F21Y 103/10*** | (2016.01) |
| ***F21Y 115/10*** | (2016.01) |

(52) U.S. Cl.

CPC ..... *E04F 11/1842* (2013.01); *E04F 11/1817* (2013.01); *F21S 4/20* (2016.01); *E04F 2011/1821* (2013.01); *E04F 2011/1872* (2013.01); *E04F 2011/1895* (2013.01); *E04F 2011/1897* (2013.01); *F21Y 2103/10* (2016.08); *F21Y 2115/10* (2016.08)

(58) Field of Classification Search

CPC ..... E04F 11/1817; E04F 11/1842; E04F 2011/1821; E04F 2011/1872; E04F 2011/1895; E04F 2011/1897; E04F 2011/1827

See application file for complete search history.

(56) References Cited

U.S. PATENT DOCUMENTS

| | | | |
|---|---|---|---|
| 2,310,593 | A | 2/1943 | Orlicki |
| 5,701,236 | A | 12/1997 | Viviano |
| 5,887,856 | A | 3/1999 | Everly, II |
| 6,065,852 | A | 5/2000 | Crumley |
| 6,425,676 | B1 | 7/2002 | Lyons |
| 7,244,040 | B2 | 7/2007 | Chen |
| 7,419,276 | B2 | 9/2008 | Sheridan |

(Continued)

FOREIGN PATENT DOCUMENTS

| | | | | |
|---|---|---|---|---|
| GB | 2404929 | | 2/2005 | |
| GB | 2404929 | A * | 2/2005 | ..... E04F 11/1804 |

*Primary Examiner* — Britt D Hanley

(74) *Attorney, Agent, or Firm* — Dickinson Wright PLLC

(57) ABSTRACT

A railing assembly includes a bottom rail and a top rail extending parallel thereto and spaced apart therefrom. Both rails include a beam defining through-holes and corresponding pocket-holes located opposite from the other rail to define ledges facing away from the other rail. A plurality of balusters of light-transmissive material each extend between the bottom rail and the top rail, through a corresponding through-hole and pocket-hole in each railing. Retaining rings are disposed around each of the balusters within each of the pocket-holes for engaging the ledges and thereby holding the balusters to each rail. Each rail may include a plate of light-transmissive material extending in a plane adjacent the beam and configured to project light along a length thereof. One or more illumination sources are disposed in the top rail and/or the bottom rail to direct light into the balusters and/or the plate(s) to provide options for multiple illumination effects.

20 Claims, 3 Drawing Sheets

(56) References Cited

U.S. PATENT DOCUMENTS

| | | | | |
|---|---|---|---|---|
| 7,438,434 | B2 | 10/2008 | Prince, Jr. et al. | |
| 7,441,919 | B2 | 10/2008 | Sheridan | |
| 7,722,207 | B2 | 5/2010 | Bennette | |
| 8,297,777 | B1 | 10/2012 | McCall | |
| 8,388,214 | B1 | 3/2013 | Toro et al. | |
| 8,424,850 | B2 | 4/2013 | Bennette | |
| 9,206,953 | B2 | 12/2015 | Roos | |
| 9,746,152 | B2 | 8/2017 | Poole et al. | |
| 10,100,527 | B1 | 10/2018 | Moeller et al. | |
| 2005/0219854 | A1 | 10/2005 | Grady | |
| 2008/0298049 | A1* | 12/2008 | Bennette | F21V 21/002 362/555 |
| 2009/0179183 | A1* | 7/2009 | Ferris | E04F 11/1817 256/67 |
| 2013/0128591 | A1* | 5/2013 | Bennette | E04F 11/1817 256/65.02 |
| 2013/0214229 | A1 | 8/2013 | Bennette | |
| 2015/0292233 | A1* | 10/2015 | Burt | E04H 17/161 256/48 |
| 2021/0180328 | A1 | 6/2021 | Lin | |

* cited by examiner

RAILING AND SUPPORT STRUCTURES WITH INTERNAL ILLUMINATION

FIELD

The present disclosure relates generally to railings and guardrails ("railings") for structures, such as decks, porches, balconies, lofts, elevated walkways, and border separations. More specifically, the present disclosure relates to railings with internal illumination.

BACKGROUND

Railings are commonly provided around borders or edges of elevated structures and along ramps and stairways. Such railings may provide an important safety function to help support people navigating such areas and to prevent people and animals from crossing a border or falling off an edge of the corresponding structure. Railings also serve important aesthetic functions, delineating and defining the usable space of an area and/or providing views therethrough to make the space feel more open to the surrounding area.

Some railings may include illumination, such as lights disposed in or protruding from posts, balusters and other parts of the railing assembly.

Some materials, while suitably strong for use as railing balusters, such as wood, aluminum, steel, vinyl, composite or concrete, are opaque which tends to obstruct a view from a structure and are not capable of internal illumination.

Some materials, while also suitably strong for use as railing balusters, such as acrylic or polycarbonate, may also be light-transmissive to reduce obstruction of a view and be capable of internal illumination, but are too flexible to safely use as balusters without the present disclosure.

SUMMARY

The present disclosure provides a railing assembly that includes a rail. The rail includes a beam defining a through-hole and a pocket-hole adjacent to and in line with the through-hole to define a ledge. The railing assembly also includes a baluster extending from within the pocket-hole, through the through-hole, and away from the beam in a direction opposite the ledge. The railing assembly also includes a baluster anchor which includes a retaining ring disposed around the baluster and configured to fit within the pocket-hole for engaging the ledge and thereby holding the baluster to the rail.

The present disclosure also provides a railing assembly that includes a rail. The rail includes a beam. The railing assembly also includes a plate of light-transmissive material extending in a plane adjacent the beam along substantially an entire length of the beam and configured to project light from an edge thereof. The railing assembly also includes one or more illumination sources disposed in the rail and configured to direct the light into the plate.

BRIEF DESCRIPTION OF THE DRAWINGS

Further details, features and advantages of designs of the invention result from the following description of embodiment examples in reference to the associated drawings.

DETAILED DESCRIPTION

Figure 1:
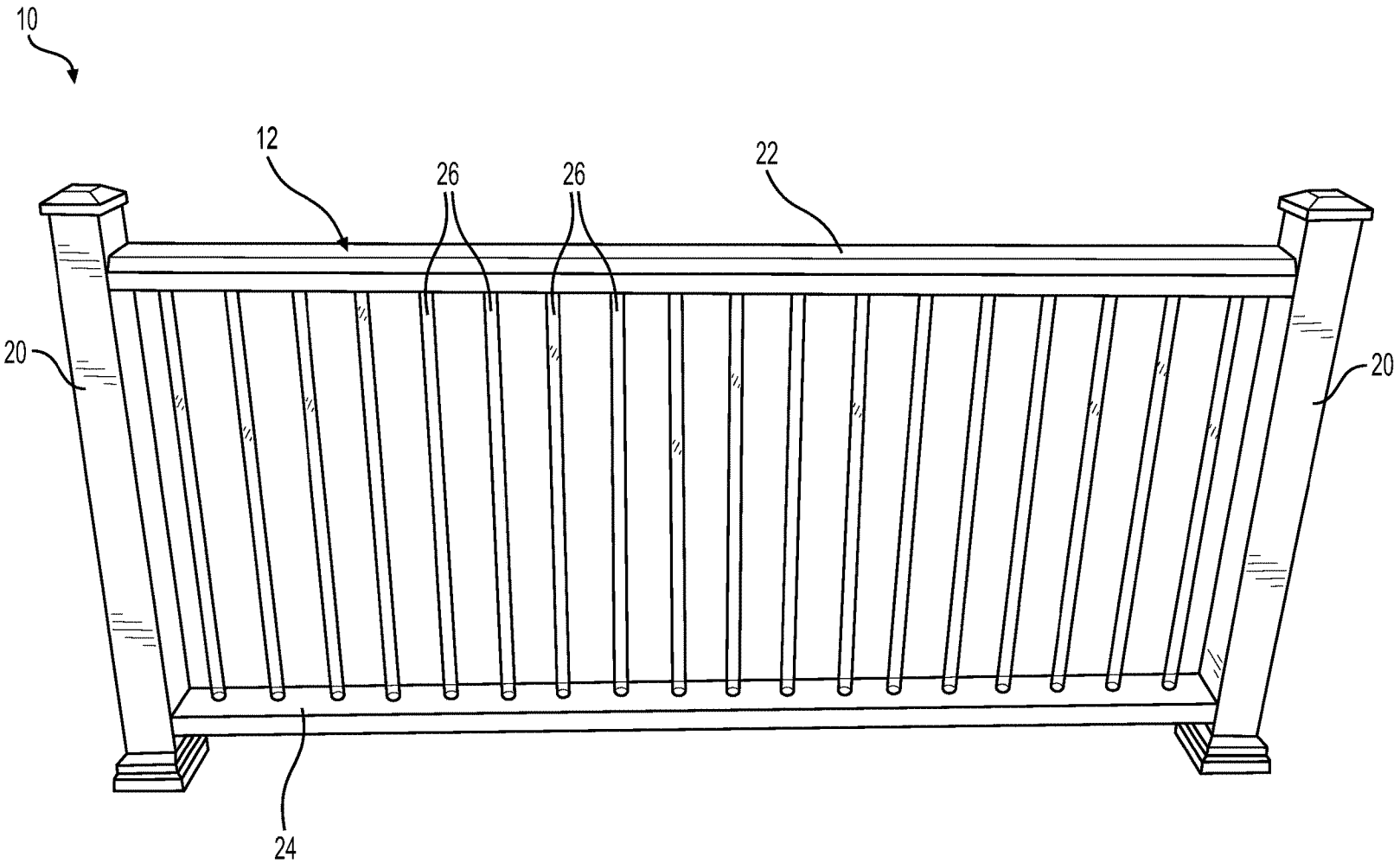
FIG. 1 shows a railing assembly of the present disclosure.

Referring to the drawings, the present invention will be described in detail in view of following embodiments. The present disclosure provides a railing assembly 10 that includes one or more railing sections 12. The railing assembly 10 may be installed along a border or periphery of an elevated structure, such as a deck, porch, balcony, loft, or an elevated walkway. FIG. 1 shows a railing assembly 10 having only one railing section 12 that extends horizontally. However, the railing assembly 10 of the present disclosure may include any number of railing sections 12. Furthermore, the railing sections 12 may have any orientation, including generally horizontal sections, as shown in FIG. 1, vertical sections, and/or inclined sections for use with an inclined structure, such as a stairway or a ramp.

A railing section, such as 12 shown in FIG. 1, may be mounted to a post 20 at each end thereof, with a top rail 22 and a bottom rail 24 extending horizontally therebetween. The top rail 22 is located above the bottom rail 24 and extends parallel to the bottom rail 24 and spaced apart therefrom. All or parts of the posts 20, the top rail 22, and the bottom rail 24 may be made of wood. Alternatively or additionally, the posts 20, the top rail 22, and/or the bottom rail 24 may include parts made of other materials, such as aluminum, steel, vinyl, plastic, a composite material, fiberboard, etc. and the size, configuration and thickness of corresponding structures, such as through-holes and/or pocket-holes in the rails 22, 24, may also vary accordingly.

The railing section 12 also includes a plurality of balusters 26 each extending vertically between the bottom rail 24 and the top rail 22 and spaced apart from one another at regular intervals. The balusters 26 may be made of light-transmissive material, such as acrylic, polycarbonate, or glass. The light-transmissive material may be translucent or transparent. In some embodiments, the light-transmissive material may be tinted one or more different colors. Alternatively, the light-transmissive material may be clear and/or white to transmit light therethrough without any change in the color of the light. Alternatively or additionally, some or all of the balusters 26 may be made of a non-light-transmissive material, such as an opaque acrylic or polycarbonate material. The balusters 26 may be spaced apart by 100 mm center-to-center. However, other spacing may be used including 4 inches on-center. The balusters 26 may each have a circular cross-section, with a diameter of three-quarters (¾) of an inch. However, the balusters 26 may have a different cross-sectional shape and/or a different size. The light-transmissive material, such as acrylic rod, may have some flexibility, which may limit their use in the balusters 26, unless they are sufficiently supported and retained at the bottom rail 24 and/or the top rail 22. When properly supported and retained, as provided in the present disclosure, a provided ¾ inch diameter baluster consisting of a flexible material such as acrylic rod can provide rigidity and strength sufficient to withstand load forces, such as for preventing a child from being able to climb or fall between the balusters 26. The provided ¾ inch acrylic rod, being light-transmissive balusters, may also provide desirable characteristics, such as providing less obstructed view therethrough, and for providing illumination effects.

Figure 2:
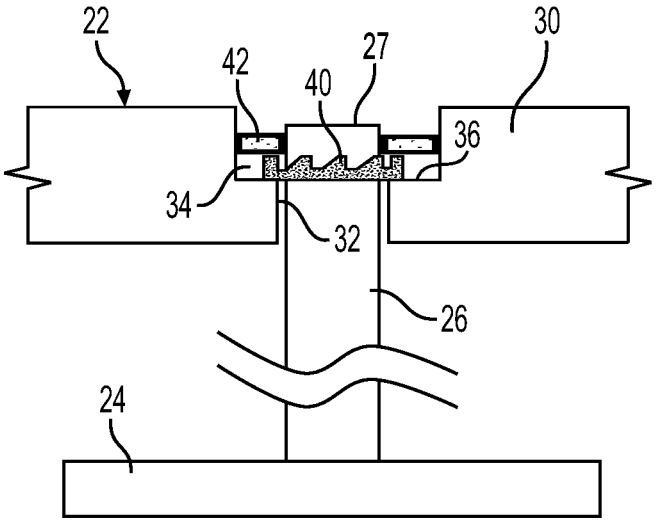
FIG. 2 shows a fragmentary cross-sectional view of the railing assembly of FIG. 1.

As shown in the cross-sectional view of FIG. 2, the top rail 22 includes a top beam 30 that defines a top through-hole 32 configured to receive one of the balusters 26. The top beam 30 also defines a top pocket-hole 34 of greater diameter than the top through-hole 32 formed adjacent-to and in-line with the top through-hole 32 and located opposite from the bottom rail 24 to define a top ledge 36 that faces away from the bottom rail 24. The top through-hole 32 and the top pocket-hole 34 may each have a cylindrical shape, and the cylindrical shapes of the top through-hole 32 and the top pocket-hole 34 may be coaxial with one-another and coaxial with a corresponding one of the balusters 26. However, either or both of the top through-hole 32 and/or the top pocket-hole 34 may have another shape. For example, if the baluster 26 had a non-circular cross-section, such as an oval or a rectangular shape, one or both of the top through-hole 32 and/or the top pocket-hole 34 may have a corresponding oval or rectangular shape. The one of the balusters 26 may extend though the top through-hole 32 and into the top pocket-hole 34. An upper end 27 of the baluster 26 may be retained in the top pocket-hole 34 to prevent the baluster 26 from being pulled through the top through-hole 32. This retention may be critical to ensure that a rod of relatively flexible material, such as some diameters of acrylic or polycarbonate, can provide the rigidity required of the baluster 26. In some embodiments, a similar retaining structure may be provided in the bottom rail 24 or in each of the top rail 22 and the bottom rail 24, and/or for each of the plurality of balusters 26 in the railing assembly 10. However, for the sake of simplicity, a retaining structure is shown and described for retaining a single one of the balusters 26 to a top rail 22.

As also shown in FIG. 2, a top retaining ring 40 is disposed around the baluster 26 adjacent to the upper end 27. The top retaining ring 40 may be spaced apart from the upper end 27 of the baluster 26 by a predetermined distance. The top retaining ring 40 may have a lower end that is positioned to be a preset distance, such as 0.25 inch from the upper end 27 of the baluster 26. The top retaining ring 40 is configured to fit within the top pocket-hole 34 for engaging the top ledge 36 of the top pocket-hole 34 and thereby holding the baluster 26 to the top rail 22, and preventing the upper end 27 of the baluster 26 from moving downwardly through the top through-hole 32.

A top lateral support ring 42 is disposed around the baluster 26 and within the top pocket-hole 34 between the top retaining ring 40 and a corresponding end of the baluster 26, i.e. the top end, and is configured to limit lateral movement of the corresponding end of the baluster 26. By limiting lateral movement of the end of the baluster 26, the top lateral support ring 42 may reduce flexibility and/or increase rigidity of the baluster 26. The top lateral support ring 42 may oppose a lateral movement of the end of the baluster 26 caused by a lateral force applied to a central region of the baluster 26, and which may be reacted by the top retaining ring 40 acting as a fulcrum. For example, the top lateral support ring 42 may counteract a bending force from a child or small animal trying to squeeze between two adjacent balusters 26. The top lateral support ring 42 may be made of a rigid material such as metal or plastic. Alternatively or additionally, the top lateral support ring 42 may include a hardening adhesive material, such as polyurethane glue. Additionally or alternatively, the top lateral support ring 42 may further secure the baluster 26 with the top beam 30. In some embodiments, the top lateral support ring 42 may extend around the top retaining ring 40.

Figure 3A:
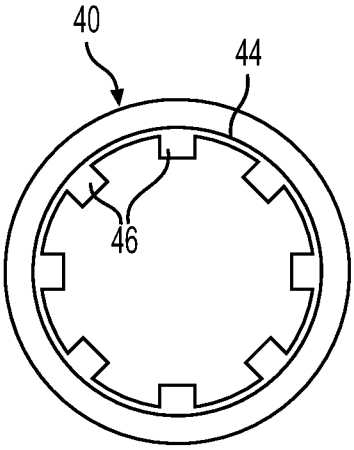
FIG. 3A shows a retaining ring of the railing assembly of FIG. 1.
Figure 3B:
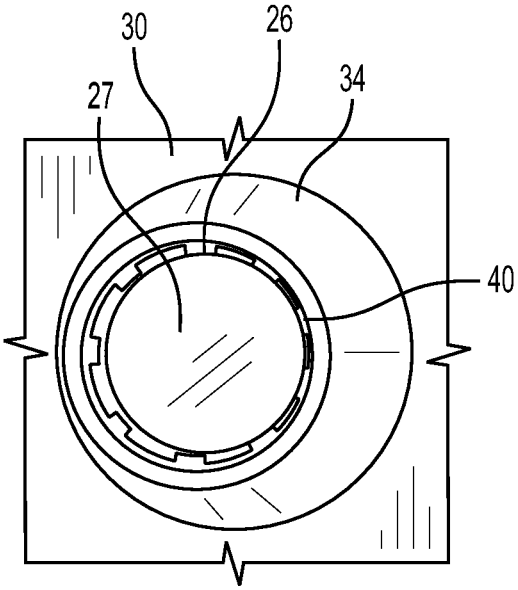
FIG. 3B shows a cut-away fragmentary view of a top beam of the railing assembly of FIG. 1.

The top retaining ring 40 may be made of metal, such as spring steel. However, other materials may be used. The top retaining ring 40, as shown in FIG. 3A, includes an annular portion 44 and plurality of internal teeth 46 extending radially inwardly from the annular portion and configured to engage a peripheral wall of the baluster 26. Each of the internal teeth 46 may have a generally rectangular shape, although other shapes may be used. The internal teeth 46 may be angled upwardly in order to pass over the upper end 27 of the baluster 26 and to bite into the peripheral wall to prevent the baluster 26 from pulling out of the top retaining ring thereby preventing the baluster 26 from pulling out of the top through-hole 32. The top retaining ring 40 thereby holds the baluster 26 within the top pocket-hole 34, as shown in FIG. 3B.

Alternatively or additionally some embodiments, the bottom rail 24 may include one or more retaining structures (not shown in the FIGS.) configured to retain corresponding ones of the balusters 26 and to prevent the balusters 26 from pulling out of the bottom rail 24. These retaining structures in the bottom rail 24 may be similar or identical to the retaining structures in the top rail 22, described above. For example, the bottom rail 24 may define a second through-hole for receiving one of the balusters 26. The second through-hole may be similar or identical to the top through-hole 32 in the top beam 30. The bottom rail 24 may define a second pocket-hole adjacent to and in-line with the second through-hole and located opposite from the top rail 22 to define a second ledge facing away from the top rail 22. This second pocket-hole and second ledge may be formed as a mirror-image of the top pocket-hole 34 and top ledge 36 in the top beam 30. A second retaining ring (not shown in the FIGS.) may be disposed around the baluster 26 adjacent to a lower end thereof and configured to fit within the second pocket-hole for engaging the second ledge and thereby holding the baluster to the bottom rail. The second retaining ring may be similar or identical to the top retaining ring 40.

A second, bottom lateral support ring (not shown in the FIGS.) may be disposed within the second pocket-hole around the baluster 26 to further secure the baluster 26 with the bottom rail 24 and/or to reduce flexibility and/or increase rigidity of the baluster 26. The bottom lateral support ring may be similar or identical to the top lateral support ring 42.

Figure 4:
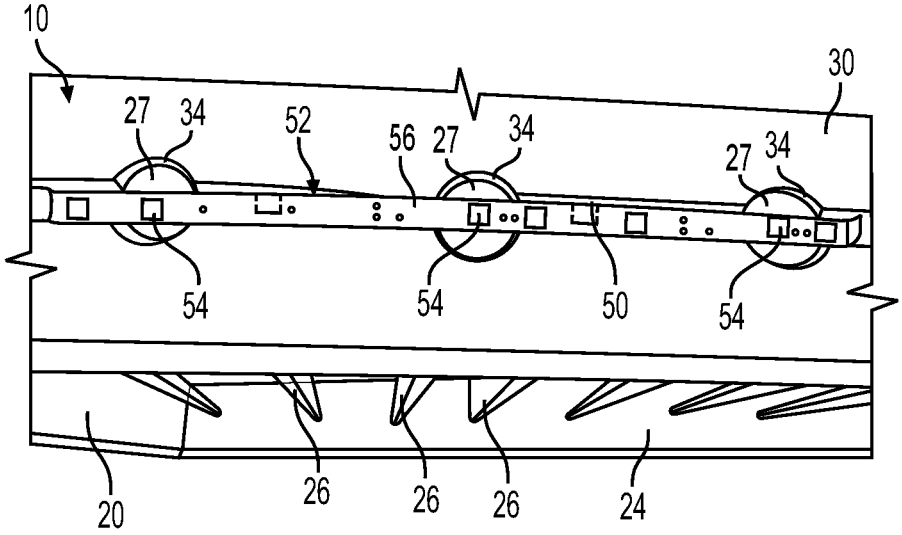
FIG. 4 shows a cut-away view of the top beam of the railing assembly of FIG. 1.

FIG. 4 shows a cut-away view of the top beam 30 of the railing assembly 10. In an assembled configuration, this view of the top beam 30 may be covered by a top cap (not shown) that overlies the top beam 30. FIG. 4 shows a plurality of the top pocket-holes 34 in a top face of the top beam 30, with each of the top pocket-holes 34 aligned with a corresponding one of the balusters 26 protruding through the corresponding top through-hole 32.

FIG. 4 also shows a groove 50, which may also be called a dado or trough, cut in a top surface of the top beam 30 and extending along a length of the top beam 30. The groove 50 is aligned with each of the balusters 26. More specifically, the groove 50 runs along a centerline of the top beam 30 and intersects a center of each of the top pocket-holes 34. An illumination source is disposed in the top rail 22 and is configured to direct light into the upper end 27 of each of the balusters 26. Each of the balusters 26 may radiate the light from the illumination source along a length thereof. For example, the balusters 26 may appear to glow along the visible length between the top rail 22 and the bottom rail 24. The color and/or intensity of the light radiated or projected from each of the balusters 26 may be predetermined and/or adjustable at any given time. Alternatively or additionally, the illumination source may be disposed in the bottom rail 24 and configured to direct light into a corresponding lower end of the baluster 26. In some embodiments, the illumination source may provide white light. Alternatively or additionally, the illumination source may be configured to provide multi-colored light, or light that can be changed to different colors. In one example configuration, the top rail 22 may include a first illumination source configured to produce white light, and the bottom rail 24 may include a second illumination source configured to produce multi-colored light, and the balusters 26 may be illuminated by either or both the first and/or second illumination sources, or vice-versa.

In some embodiments, and as shown in FIG. 4, the illumination source includes a lighting strip 52 with a plurality of light emitting diodes (LEDs) 54 disposed thereupon. For example, the lighting strip 52 may include a substrate tape 56 that extends within the groove 50 along a length of the top rail 22, to illuminate some or all of the balusters 26. The illumination source may include other types of devices, such as incandescent bulbs, fluorescent bulbs, organic LED (OLED) devices, lasers, etc. The illumination source may include one or more lenses, mirrors, light pipes, optical fibers, etc. to direct and/or to focus the light to provide a desired effect. In some embodiments, the illumination source includes point sources, such as individual LEDs 54 on one or both of two opposite faces thereof. For example, the lighting strip 52 may include the LEDs 54 on a bottom surface and/or on a top surface thereof. The LEDs 54 may be embedded in the lighting strip 52 and spaced apart from one another along a length of the lighting strip 52. In some embodiments, at least some of the LEDs 54 may be aligned with the regular intervals of the balusters 26. For example, the illumination source may be configured with a corresponding one of the LEDs 54 aligned with the upper end 27 of each of the balusters 26 to produce and direct light directly into the upper ends 27 of the balusters 26. Some or all of the LEDs 54 may be spaced apart by 100 mm on-center, corresponding to the spacing between the balusters 26 and/or have additional LEDs in the groove 50 between the balusters 26. Such additional LEDs may be used for additional illumination effects. For example, the additional LEDs may illuminate a plate of light-transmissive material, described below.

Figure 5:
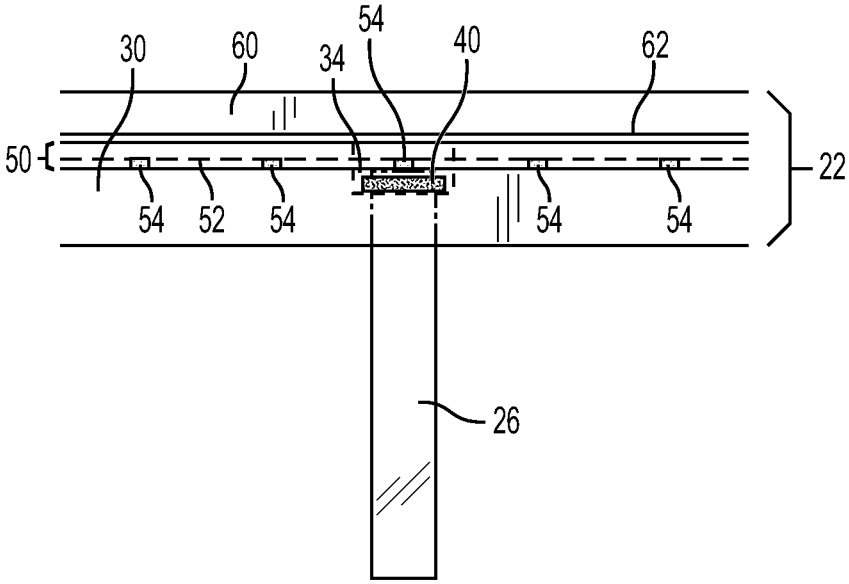
FIG. 5 shows a fragmentary cross-sectional view of a railing assembly of the present disclosure.

FIG. 5 shows a cut-away view through a vertical plane extending through a centerline of the railing assembly 10, including internal details of the top rail 22. As shown in FIG. 5, the top rail 22 includes the top beam 30, with a top cap 60 overlying the top beam 30 and covering the lighting strip 52. The lighting strip 52 may, therefore, not be directly visible to an observer viewing the railing assembly 10.

In some embodiments, and as shown in FIG. 5, a plate 62 of light-transmissive material, such as acrylic, polycarbonate or glass, is located between the top beam 30 and the top cap 60 and just above the lighting strip 52. The light-transmissive material may be translucent or transparent. In some embodiments, the light-transmissive material may be tinted one or more different colors. Alternatively, the light-transmissive material may be clear and/or white to transmit light therethrough without any change in the color of the light. The plate 62 may be sandwiched between the top cap 60 and the top beam 30 and configured to project light outwardly along a length thereof. The plate 62 may have a thickness of 0.25 inch. However, the plate 62 may have a different thickness that may be larger than or smaller than 0.25 inch. The illumination source, such as the lighting strip 52, may be configured to direct light into the plate 62, thus providing an additional or alternative lighting effect. For example, the plate 62 may appear as a thin horizontal bar of light extending along the top rail 22 of the railing assembly 10. In some embodiments, some of the LEDs 54 may be dedicated to illuminating the balusters 26, while other ones of the LEDs 54 may be dedicated to illuminating the plate 62 and in some embodiments, some or all of the LEDs 54 may illuminate both the balusters 26 and the plate 62. For example, the lighting strip 52 may include LEDs 54 mounted on each of two opposite faces, with the LEDs 54 mounted on one face configured to illuminate the balusters 26, and with the LEDs 54 mounted on an opposite face configured to illuminate the plate 62. In this way, the railing assembly 10 may be operated to include independently illuminating the balusters 26 and the plate 62. The balusters 26 and the plate 62 may be set with different colors, brightness levels, etc.

The foregoing description is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. For example, the foregoing descriptions of the top rail and its embodiments is equally applicable to the bottom rail or to a railing assembly in which the rails are vertical and the balusters are horizontal.

What is claimed is:

1. A railing assembly comprising:

a rail including a beam defining a through-hole and a pocket-hole adjacent to and in line with the through-hole to define a ledge;

a baluster extending from within the pocket-hole, through the through-hole, and away from the beam in a direction opposite the ledge;

a baluster anchor including a retaining ring disposed around the baluster and configured to fit within the pocket-hole for engaging the ledge and thereby holding the baluster to the rail; and an illumination source disposed in the rail and configured to direct light into a corresponding end of the baluster, wherein the through-hole is one of a plurality of through-holes each defined by the beam, and wherein the baluster is one of a plurality of balusters each protruding through a corresponding through-hole of the plurality of through-holes and spaced apart from one another at regular intervals.

2. The railing assembly of claim 1, wherein the baluster is made of light-transmissive material.

3. The railing assembly of claim 2, wherein the light-transmissive material comprises at least one of acrylic, polycarbonate, or glass.

4. A railing assembly comprising:

a rail including a beam defining a through-hole and a pocket-hole adjacent to and in line with the through-hole to define a ledge;

a baluster extending from within the pocket-hole, through the through-hole, and away from the beam in a direction opposite the ledge; and a baluster anchor including a retaining ring disposed around the baluster and configured to fit within the pocket-hole for engaging the ledge and thereby holding the baluster to the rail, wherein the retaining ring includes an annular portion and plurality of internal teeth extending radially inwardly from the annular portion and configured to engage a peripheral wall of the baluster.

5. The railing assembly of claim 1, wherein the baluster is made of light-transmissive material, and wherein the baluster radiates the light from the illumination source along a length thereof.

6. The railing assembly of claim 5, wherein the illumination source comprises a lighting strip having a plurality of light emitting diodes disposed thereupon.

7. The railing assembly of claim 6, wherein the baluster is one of a plurality of balusters of light-transmissive material each extending from the rail and spaced apart from one another at regular intervals; and wherein at least some of the plurality of light emitting diodes are aligned with the regular intervals of the plurality of balusters.

8. The railing assembly of claim 5, wherein the beam defines a groove extending along a length thereof of the beam; and wherein the illumination source is located within the groove.

9. The railing assembly of claim 5, wherein the rail further comprises a cap disposed along a length of the beam and located opposite from the baluster; and wherein the cap defines a groove, and wherein the illumination source is located within the groove.

10. The railing assembly of claim 1, wherein the baluster is one of a plurality of balusters of light-transmissive material each extending from the rail and spaced apart from one another at regular intervals.

11. The railing assembly of claim 1, further comprising:

a bottom rail;

a top rail disposed above the bottom rail, extending parallel thereto, and spaced apart therefrom; and wherein the rail is one of the bottom rail or the top rail, and the baluster extends between the bottom rail and the top rail.

12. The railing assembly of claim 1, wherein the baluster anchor further includes a lateral support ring disposed around the baluster and within the pocket-hole between the retaining ring and a corresponding end of the baluster and configured to limit lateral movement of the corresponding end of the baluster.

13. The railing assembly of claim 1, wherein the rail further comprises:

a cap disposed along a length of the beam and located opposite from the baluster; and a plate of light-transmissive material sandwiched between the cap and the beam and configured to project light along a length thereof.

14. A railing assembly comprising:

a rail including a beam;

a plate of light-transmissive material extending in a plane adjacent the beam along substantially an entire length of the beam and configured to project light from an edge thereof; and one or more illumination sources disposed in the rail and configured to direct the light into the plate;

wherein the rail further comprises a cap overlying or underlying the beam and extending along a length of the beam; and wherein the plate is sandwiched between the cap and the beam.

15. The railing assembly of claim 14, wherein at least one of the beam and the cap defines a groove extending along a length thereof; and wherein the one or more illumination sources is located within the groove.

16. The railing assembly of claim 14, wherein the one or more illumination sources comprises one or more lighting strips having a plurality of light emitting diodes disposed thereupon.

17. The railing assembly of claim 14, further comprising a plurality of balusters of light-transmissive material each extending from the rail and spaced apart from one another at regular intervals; and wherein the one or more illumination sources is further configured to direct light into at least one baluster of the plurality of balusters.

18. The railing assembly of claim 17, wherein the beam defines a through-hole configured to receive a baluster of the plurality of balusters, and a pocket-hole adjacent to and in line with the through-hole to define a ledge; and wherein the railing assembly further comprises a retaining ring disposed around the baluster of the plurality of balusters and configured to fit within the pocket-hole for engaging the ledge and thereby holding the baluster of the plurality of balusters to the beam.

19. The railing assembly of claim 18, wherein the retaining ring includes an annular portion and plurality of internal teeth extending radially inwardly from the annular portion and configured to engage a peripheral wall of the baluster of the plurality of balusters.

20. The railing assembly of claim 18, further comprising a lateral support ring disposed around the baluster and within the pocket-hole between the retaining ring and a corresponding end of the baluster and configured to limit lateral movement of the corresponding end of the baluster.

* * * * *